US008236138B2

(12) United States Patent
Thomisch et al.

(10) Patent No.: US 8,236,138 B2
(45) Date of Patent: Aug. 7, 2012

(54) HEADBOX FOR A MACHINE FOR PRODUCING A FIBROUS WEB

(75) Inventors: Marco Thomisch, Essingen (DE); Wolfgang Ruf, Herbrechtingen (DE); Volker Schmidt-Rohr, Heidenheim (DE); Markus Häubler, Herbrechtingen (DE); Hans Loser, Langenau (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/149,093

(22) Filed: May 31, 2011

(65) Prior Publication Data

US 2011/0290440 A1 Dec. 1, 2011

Related U.S. Application Data

(63) Continuation of application No. PCT/EP2009/063838, filed on Oct. 22, 2009.

(30) Foreign Application Priority Data

Dec. 18, 2008 (DE) ..... 10 2008 054 897

(51) Int. Cl.
*D21F 1/18* (2006.01)

(52) U.S. Cl. ..... 162/341

(58) Field of Classification Search ..... 162/341, 162/343

See application file for complete search history.

(56) References Cited

FOREIGN PATENT DOCUMENTS

| | | | |
|---|---|---|---|
| DE | 44 16 898 | A1 | 11/1995 |
| DE | 44 16 899 | A1 | 11/1995 |
| DE | 44 16 909 | A1 | 11/1995 |
| DE | 199 26 805 | A1 | 12/2000 |
| DE | 102 45 154 | A1 | 4/2004 |
| DE | 10 2008 043 145 | A1 | 4/2010 |
| DE | 10 2008 054 898 | A1 | 6/2010 |
| EP | 0 629 739 | A1 | 12/1994 |
| EP | 0 683 266 | A1 | 11/1995 |
| EP | 0 824 157 | A2 | 2/1998 |
| EP | 0 629 739 | B1 | 9/1999 |
| EP | 2 199 459 | A1 | 6/2010 |

OTHER PUBLICATIONS

PCT/EP2009/063838 International Search Report dated Jan. 22, 2010. (2 pages).

(Continued)

*Primary Examiner* — Mark Halpern
(74) *Attorney, Agent, or Firm* — Taylor IP, P.C.

(57) ABSTRACT

The invention relates to a headbox for a machine for producing a fibrous web, in particular a paper or cardboard web, from at least one fibrous stock suspension, having a feed apparatus which feeds the at least one fibrous stock suspension, having a distributor-pipe perforated plate which is adjacent downstream and has a multiplicity of channels which are arranged in rows and in columns, having an intermediate channel which lies downstream of the latter, extends over the width of the headbox and has a plurality of means which are spaced apart from one another in the width direction of the headbox for the preferably regulatable/controllable metering of a fluid in fluid part streams into the at least one fibrous stock suspension. The headbox according to the invention is characterized in that the means for the preferably regulatable/controllable metering of the fluid in fluid part streams into the at least one fibrous stock suspension is also configured for the preferably regulatable/controllable metering of at least one further fluid in fluid part streams into the at least one fibrous stock suspension, wherein the individual means comprises in each case a plurality of metering channels for the at least one further fluid, which metering channels have a respective metering-channel opening, open at different heights and are connected to a common supply channel.

22 Claims, 3 Drawing Sheets

OTHER PUBLICATIONS

Written Opinion (undated) of the International Searching Authority for PCT/EP2009/063838 (5 pages).
International Search Report dated Jan. 22, 2010 for PCT/EP2009/063837 (2 pages).
English translation of International Preliminary Report on Patentability dated Jun. 21, 2011 for PCT/EP2009/063837 (7 pages).
English translation of Written Opinion of the International Searching Authority (undated) for PCT/EP2009/063837 (6 pages).
International Search Report dated Jan. 22, 2010 for PCT/EP2009/063838 (2 pages).
English translation of International Preliminary Report on Patentability dated Jun. 21, 2011 for PCT/EP2009/063838 (8 pages).
English translation of Written Opinion of the International Searching Authority (undated) for PCT/EP2009/063838 (7 pages).
International Search Report dated Jan. 22, 2010 for PCT/EP2009/063846 (2 pages).
English translation of International Preliminary Report on Patentability dated Jun. 21, 2011 for PCT/EP2009/063846 (7 pages).
English translation of Written Opinion of the International Searching Authority (undated) for PCT/EP2009/063846 (6 pages).

HEADBOX FOR A MACHINE FOR PRODUCING A FIBROUS WEB

CROSS REFERENCE TO RELATED APPLICATIONS

This is a continuation of PCT application No. PCT/EP2009/063838, entitled "HEADBOX FOR A MACHINE FOR PRODUCING A FIBROUS WEB", filed Oct. 22, 2009, which is incorporated herein by reference.

BACKGROUND OF THE INVENTION

1. Field of the Invention

The invention relates to a headbox for a machine for producing a fibrous web, in particular a paper or cardboard web from at least one fibrous stock suspension, having a feed apparatus for feeding the at least one fibrous stock suspension, having a perforated distributor pipe plate which is located adjacent downstream and has a multiplicity of channels which are arranged in rows and columns, having an intermediate channel which is located downstream of the latter, extending over the width of the headbox and which has a plurality of means which are spaced apart from one another in width direction of the headbox, for preferably adjustable/controllable dosing of fluid in partial fluid streams into the at least one fibrous stock suspension, wherein the individual means respectively comprises a plurality of dosing channels for the fluid, which respectively have one dosing channel opening and which discharge at different heights and which are connected with a common supply channel; with a downstream turbulence generator having a plurality of flow channels arranged in rows and columns, and with a headbox nozzle comprising a nozzle gap immediately adjacent to the turbulence generator.

2. Description of the Related Art

A headbox of this type is known in the field as "Dilution water headbox" and is known for example from German disclosure documents DE 44 16 898 A1, DE 44 16 899 A1 and DE 44 16 909 A1.

German disclosure document DE 44 16 898 A1 describes a headbox for a paper machine; including a feed device for the stock suspension comprising a guiding element with a plurality of channels; upstream from a guiding element a mixing chamber with several infeed devices which are distributed over the headbox for a fluid which is to be added to the stock suspension and which differs in its characteristics from the stock suspension; and with a nozzle chamber forming an outlet opening for the stock suspension, located immediately downstream from the guiding element. The feed devices for the fluid which is to be added extend essentially vertically in the mixing chamber and comprise several dosing openings located on top of each other.

German disclosure document DE 44 16 899 A1 describes a headbox for a paper machine including a feed device for the stock suspension, with a first guiding element comprising a plurality of channels, a second guiding element comprising a plurality of channels, an intermediate mixing chamber, a contiguous nozzle chamber forming an outlet opening for the stock suspension, and several feed lines distributed over the headbox for the fluid which is to be added. The majority of the channels of the guiding elements are positioned and dimensioned so that the outlet opening of the upstream guiding element is not aligned with a confluence into the downstream guiding element. The feed lines for the fluid which is to be added are equipped with dosing openings, the majority of which align respectively with a confluence into the downstream guiding element.

In addition, German disclosure document DE 44 16 909 A1 describes a headbox for a paper machine with a feed device for the stock suspension, a downstream contiguous guiding element equipped with a plurality of channels, located downstream from there a downstream mixing chamber extending across the width of the headbox with several separation walls distributed across the headbox and extending essentially in flow direction, as well as feed devices for a fluid which is to be added, distributed in cross direction of the headbox and which are equipped with dosing openings, downstream an additional guiding element equipped with a plurality of channels and adjacent to it, one nozzle chamber forming an outlet opening for the stock suspension.

The feed devices for the fluid which is to be added extend into the mixing chamber and the sectional area which is formed in the mixing chamber by the separation walls begins in the region of the dosing openings from where it extends essentially in flow direction to the second guiding element.

In the currently known processes for producing a fibrous web, in particular a paper or cardboard web from at least one fibrous stock suspension additional fluids, for example paper chemicals, especially retention agents or dewatering accelerators are added as a rule before and/or after the separator, however prior to the headbox and in any case before or at the latest in the feed apparatus. Separators or sorters, also referred to as screens by the expert, can be in the embodiment for example of a vertical separator or as a machine wire. They serve in cleaning the at least one fibrous stock suspension before it is transported on into the headbox.

In practical operation it turned out that—viewed in flow direction—areas with strong pressure losses or respectively turbulence fields with strong shear fields follow the known locations for adding the additional fluids. The effect of the additional high molecular or respectively additional polymeric fluids, preferably paper chemicals, in particular retention agents or dewatering accelerators is thereby diminished or can be diminished. In addition, process technologically important reaction times of the mediums cannot be adjusted, or cannot be adjusted to a satisfactory level, especially defined with the known systems.

It is therefore the objective of the current invention, and what is needed in the art is, to improve a headbox of the type described at the beginning in such a manner, that the aforementioned disadvantages of the current state of the art are significantly, preferably completely eliminated. The intent is for the headbox to facilitate especially an efficient and cost effective addition of the at least one additional fluid into the at least one fibrous stock suspension into which the fluid is to be added. In particular, the trilemma should be solved so that on the one hand in certain areas of the headbox, for example in the turbulence generator turbulent flows are desirable at least to a certain extent for the purpose of intensive blending of the components of the at least one fibrous stock suspension to which the at least one fluid is added. That however, on the other hand in certain other areas of the headbox, for example in the headbox nozzle no further blending and therefore not additional swirling of the components of the at least one fibrous stock suspension to which the at least one fluid is added is desirable, and thirdly, so that the effect of certain high molecular or long-chain components of the fibrous stock suspension are not reduced, particularly through turbulence and thereby caused shear fields.

SUMMARY OF THE INVENTION

According to the present invention this objective is solved in, and the present invention provides, a headbox of the type described at the beginning in that means for preferably adjustable/controllable dosing of fluid in partial fluid streams into the at least one fibrous suspension is designed also for preferably adjustable/controllable dosing of at least one additional fluid in partial fluid streams into the at least one fibrous suspension, wherein the individual means respectively comprises a plurality of dosing channels for the at least one additional fluid, each having a respective dosing channel opening, discharging at different heights and being connected to a common supply channel.

The inventive objective is completely solved in this manner.

The inventive design of the headbox of the type described at the beginning extensively, preferably completely eliminates the aforementioned disadvantages of the current state of the art. Addition of the at least one additional fluid into the at least one fibrous stock suspension to which a fluid is to be added, occurs extremely efficiently and cost effectively in the area of the headbox based on the described design of the means, whereby the headbox alone can also be designed cost effectively and technically simple. Lastly, the inventive design of the headbox provides a satisfactory solution of the described trilemma while providing an as uniform as possible distribution of the at least one additional fluid over "Z" direction, that is in height direction of the headbox. The inventive headbox may moreover be in the embodiment of a single layer headbox and may possess properties which are characterizing for a multi-layer headbox.

Also at least one separation element which is well known to the expert, in particular a lamella may be provided in the headbox nozzle of the inventive headbox. In the event that several separating elements, in particular lamellas are arranged in the headbox nozzle of the inventive headbox they may have different lengths and possibly different properties such as surface profiles.

Dosing of the at least one additional fluid into the at least one fibrous stock suspension which is to be provided with a fluid can be adjusted/controlled, at least in areas, in a manner obvious to the expert—in width direction of the headbox, in other words in "Y" direction and/or in height direction of the headbox, in other words in "Z" direction.

A first preferred design form provides that the dosing channels of the means for preferably adjustable/controllable dosing of fluid in partial fluid streams into the at least one fibrous stock suspension which are connected with the common supply channel discharge through dosing channel openings in the downstream area of the means for the preferably adjustable/controllable dosing and that the dosing channels of the means for preferably adjustable/controllable dosing of the at least one additional fluid in partial fluid streams into the at least one fibrous stock suspension which are connected with the common supply channel discharge through dosing channel openings at least on one side, preferably on both sides of the side area of the means for preferably adjustable/controllable dosing. Therefore, a physically separated, physically independent and uniform dosing of the fluids can occur, with the objective of producing a fibrous web having high quality properties. Depending on the specific application, only one column of flow channels of the turbulence generator, or even two columns of flow channels of the turbulence generator may be supplied with the at least one additional fluid.

Hereby the dosing channels of the means for preferably adjustable/controllable dosing of the at least one additional fluid in partial fluid streams into the at least one fibrous stock suspension which are connected with the common supply channel discharge preferably through dosing channel openings on at least one side, preferably both sides of the side area of the means for preferably adjustable/controllable dosing, in an angle of 0 to 180°, preferable 45 to 135°, especially approximately 90° to the flow direction of the at least one fibrous stock suspension. Depending on orientation of the dosing channel openings, different intensities of impulses may be introduced into the blending areas, thereby influencing the mixing quality.

To enable a process technologically sufficient dosing of the at least one additional fluid and to provide the precondition for a sufficiently large operational window for the headbox, the dosing channel of the means for preferably adjustable/controllable dosing of the at least one additional fluid in partial fluid streams into the at least one fibrous stock suspension which is connected with the common supply channel preferably has a circular cross sectional surface with a diameter of 2 to 10 mm, preferably 4 to 6 mm. In addition, the common supply channel of the means for preferably adjustable/controllable dosing of the at least one additional fluid in partial fluid streams into the at least one fibrous stock suspension preferably has a circular cross sectional surface with a diameter of 6 to 20 mm, preferably 10 to 15 mm. This surface area continuously ensures the feasibility of sufficiently large volume flows for the purpose of producing a fibrous web having high quality properties. The respective cross sectional surface can progress—at least in areas—constant, conical or stepped and the respective depth of the supply channel depends substantially on the number of rows of flow channels in the turbulence generator.

In addition the dosing channels of the means for preferably adjustable/controllable dosing of the at least one additional fluid in partial fluid streams into the at least one fibrous stock suspension which are connected with the common supply channel and which discharge through dosing channel openings on both sides of the side area of the means for preferably adjustable/controllable dosing can be arranged alternating. The dosing channels of the means for preferably adjustable/controllable dosing of the at least one additional fluid discharging at different heights can also be arranged at equal distances from each other. These embodiments allow for the greatest possible flexibility during design and operation of the headbox and ensure continually optimum conditions for the production of a fibrous web having high quality properties.

In an additional preferred embodiment the number of dosing channels in the means for preferably adjustable/controllable dosing of the at least one additional fluid is equal to the number of rows of flow channels in the downstream turbulence generator. This row-related dosing essentially provides process technological advantages.

Also, the number of dosing channels of the entire means for preferably adjustable/controllable dosing for the at least one additional fluid can be equal to the number of flow channels in the turbulence generator located downstream. This "1:1" dosing essentially provides additional process technological advantages.

The means for preferably adjustable/controllable dosing of the at least two fluids further advantageously have a preferably uniform spacing in width direction of the headbox in the range of 10 to 100 mm, preferably of 25, 33, 50 or 66 mm. This helps to ensure a high quality dosing of the at least two fluids across the entire width of the headbox.

The respective means for preferably adjustable/controllable dosing of fluid in partial fluid streams into the at least one fibrous stock suspension preferably comprises a dosing sword as described and illustrated in the German patent application DE 10 2008 054 898.7 (Applicant File: HPA14265 DE and Applicant-Title:"MJ II-DoS-TE-Geometry") with same German application date as the German patent application corresponding to the present application. The relating disclosure content of German patent application DE 10 2008 054 898.7 is herewith made subject matter of the current description.

In regard to a compact design of the headbox it is also advantageous if the means in the form preferably of a dosing sword for preferably adjustable/controllable dosing of the at least two fluids in partial fluid streams into the at least one fibrous stock suspension has a length in the range of 60 to 350 mm, preferably 100 to 250 mm, and a height in the range of 50 to 300 mm, preferably 75 to 250 mm.

The fluid consists preferably of water, especially clarified water or white water, or of a fibrous stock suspension whose concentration is different than the average concentration of the at least one fibrous stock suspension in the headbox. These types of fluids have already proven themselves well in similar applications.

And the at least one additional fluid includes preferably at least one retention agent, especially high molecular compounds like polyamines, polyamidoamines, polyacrylamides, polyethylenimines, cationic starch or guarderviates, or a dewatering accelerator, especially polyamines or polyethylenimines.

The at least one additional fluid can however also include a chemical of a different kind, especially clarified water or white water, a filler, fines or other additive which can be used to produce fibrous webs.

The inventive headbox is extremely well suited for utilization in a machine for the production of a fibrous web, especially a paper or cardboard web. The fibrous web produced in the machine with at least one inventive headbox possesses outstanding properties throughout, since among other advantages, control of its fiber orientation cross profile as well as its base weight cross profile is possible.

The inventive headbox can of course also be in the embodiment of a multi-layer headbox. In this case all layers of the multi-layer headbox can be supplied by one and the same means for preferably adjustable/controllable dosing of at least one additional fluid in partial fluid streams into the at least one fibrous stock suspension.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
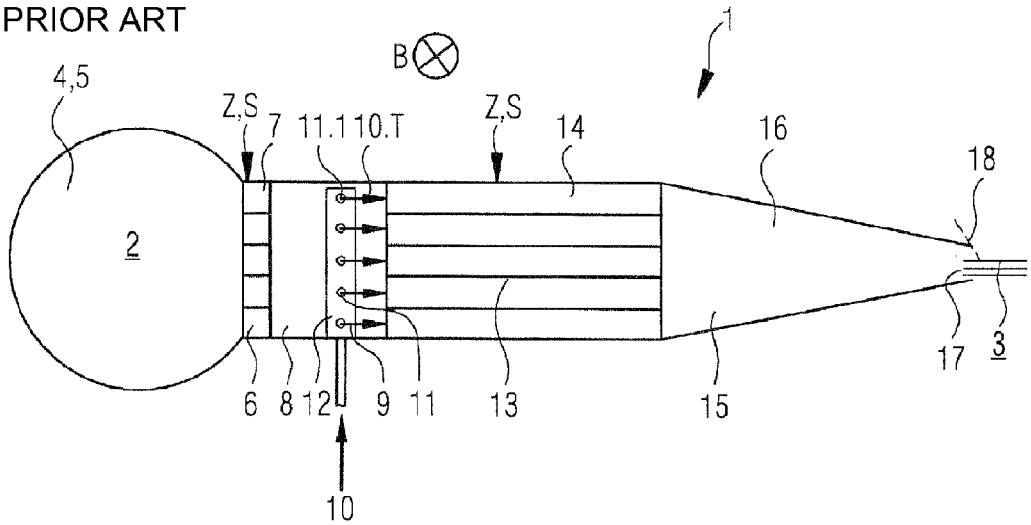
Fig.1 PRIOR ART
FIG. 1 is a vertical and schematic longitudinal sectional view of a headbox for a machine to produce a fibrous web from at least one fibrous stock suspension in accordance with the current state of the art.

FIG. 1 is a vertical and schematic longitudinal view of an exemplary design form of a headbox 1, known from the current state of the art, for a machine to produce a fibrous web 3 from a fibrous stock suspension 2. Illustrated headbox 1 may of course also be designed as a multi-layer headbox which utilizes at least two different fibrous stock suspensions to produce fibrous web 3. Fibrous web 3 can in particular, be a paper, cardboard or tissue web.

Headbox 1 comprises one feed device 4 in the embodiment of an illustrated cross distribution pipe 5 or a circular distributor having a plurality of tubes and which is not illustrated, supplying the one fibrous stock suspension 2 (arrow).

Perforated distribution pipe plate 6 which is equipped with a plurality of channels 7 which are arranged in rows Z and columns S is located downstream adjacent to feed device 4.

Again located adjacent downstream from perforated distribution pipe plate 6 is an intermediate channel 8, extending across width B (arrow) of headbox 1 and which is equipped with several means 9 for preferably adjustable/controllable dosing of a fluid 10 in partial fluid streams 10.T (arrows) into fibrous stock suspension 2, the means being spaced apart from each other in width direction of headbox 1. The individual means 9 for the preferably adjustable/controllable dosing respectively comprises several dosing channels 11 having a respective dosing channel opening 11.1, discharging at different heights and being connected to a common supply channel 12.

A turbulence generator 13 having a plurality of flow channels 14 arranged in rows Z and column S is located downstream from intermediate channel 8. During operation of headbox 1 the fibrous stock suspension 2 is divided into partial fibrous streams in turbulence generator 13 and, after emerging from the turbulence generator is brought together again in a machine-wide chamber 15 in the embodiment of a headbox nozzle 16 comprising a nozzle gap 17 in order to enable formation of a machine-wide fibrous web 3. As already known, flow channels 14 are in the embodiment of preferably thin-walled turbulence pipes and/or turbulence pipe inserts with at least partially constant, at least partially divergent, at least partially convergent and/or discontinuous cross sectional surfaces. A separating element which is well known to the expert and which is not explicitly illustrated, especially a lamella, may also be provided in headbox nozzle 16. If a multitude of separating elements, especially lamellas are provided in headbox nozzle 16, they can have different lengths and possibly also different properties, such as surface profiles, etc.

On its outlet side headbox nozzle 16 may be equipped with an aperture 18, at least on one side, which is indicated by broken lines.

Figure 2:
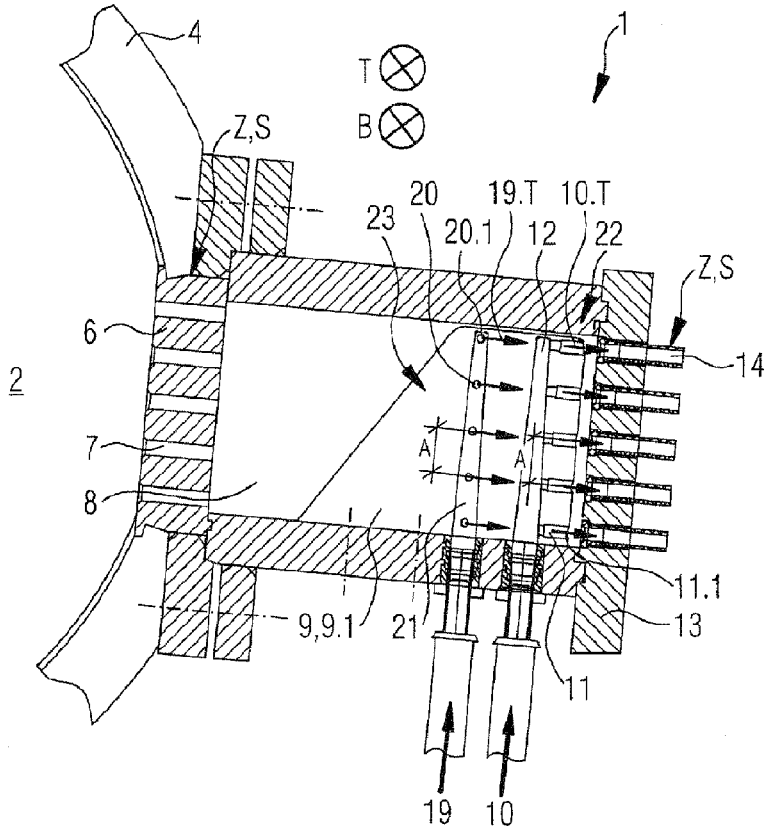
FIG. 2 is a vertical and schematic longitudinal sectional view of a first inventive design form of a headbox for a machine to produce a fibrous web from at least one fibrous stock suspension.

FIG. 2 shows a vertical and schematic longitudinal sectional view of a first inventive design form of a headbox 1 for a machine to produce a fibrous web from at least one fibrous suspension 2. The basic construction of this headbox 1 is substantially consistent with the basic construction of headbox 1 schematically depicted in FIG. 1. We therefore refer to the description provided for that drawing.

Feed device 4 is again followed by an adjacently located downstream perforated distribution pipe plate 4 which comprises a plurality of channels 7 arranged in rows Z and columns S.

Again located adjacent downstream from perforated distribution pipe plate 6 is an intermediate channel 8, extending across width B (arrow) of headbox 1 and which is equipped with several means 9 for preferably adjustable/controllable dosing of a fluid 10 (arrow) in partial fluid streams 10.T (arrows) into fibrous stock suspension 2 (arrow), the means being spaced apart from each other in width direction of headbox 1. The individual means 9 for the preferably adjustable/controllable dosing respectively comprises several dosing channels 11 having a respective dosing channel opening 11.1, discharging at different heights and being connected to a common supply channel 12.

A turbulence generator 13 having a plurality of flow channels 14 arranged in rows Z and column S is located downstream from intermediate channel 8. As already known, flow channels 14 are in the embodiment of preferably thin-walled turbulence pipes and/or turbulence pipe inserts with at least partially constant, at least partially divergent, at least partially convergent and/or discontinuous cross sectional surfaces.

In a further development of the headbox 1 illustrated in FIG. 1, the means 9 for preferably adjustable/controllable dosing of fluid 10 in partial fluid streams 10.T (arrows) into fibrous stock suspension 2 of headbox 1 illustrated in FIG. 2, is also designed for preferably adjustable/controllable dosing of one additional fluid 19 in partial fluid streams 19.T (arrows) into fibrous stock suspension 2. Herein the individual means 9 additionally comprises a plurality of dosing channels 20 for additional fluid 19, each having a respective dosing channel opening 20.1, discharging at different heights and being connected to a common supply channel 21.

The dosing of additional fluid 19 into the one fibrous stock suspension 2 which is to be provided with a fluid 10 can be adjusted/controlled, at least in areas, in a manner obvious to the expert—in width direction B (arrow) of the headbox, in other words in "Y" direction and/or in height direction of the headbox, in other words in "Z" direction.

Dosing channels 11 of means 9 for preferably adjustable/controllable dosing of fluid 10 in partial fluid streams 10.T (arrows) into fibrous stock suspension 2 which are connected with common supply channel 12 discharge through dosing channel openings 11.1 in downstream area 22 of means 9 for preferably adjustable/controllable dosing. In contrast, dosing channels 20 of means 9 for preferably adjustable/controllable dosing of additional fluid 19 in partial fluid streams 19.T (arrows) into fibrous stock suspension 2 which are connected with common supply channel 21 discharge through dosing channel openings 20.1 on both sides of the side area 23 of means 9 for preferably adjustable/controllable dosing.

Furthermore, dosing channels 11, 20 of means 9 for preferably adjustable/controllable dosing of fluid 10 and additional fluid 19 which discharge at different heights are arranged at equal distances A. Dosing channel openings 11.1, 20.1 of dosing channels 11, 20 can again be aligned toward each other, as shown in FIG. 2.

Figure 3:
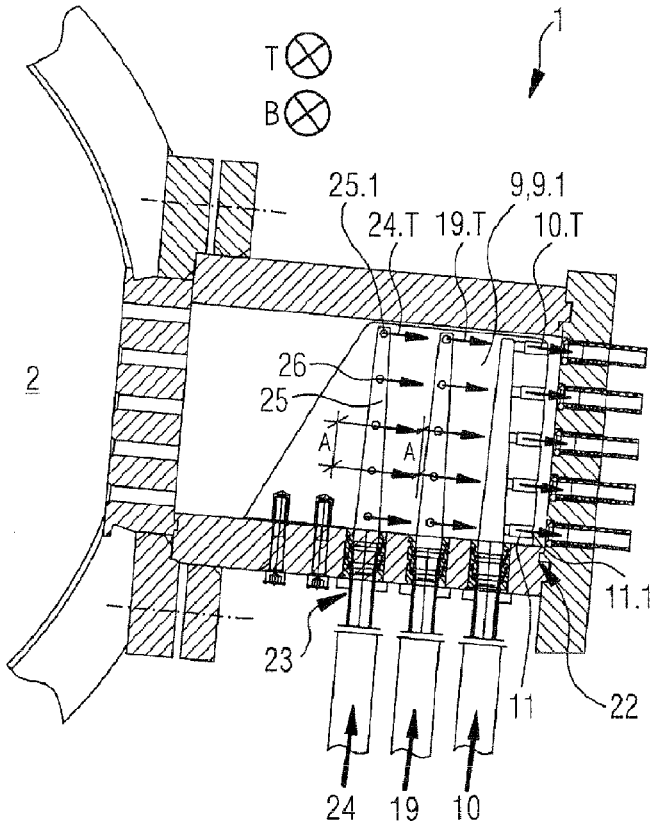
FIG. 3 is a vertical and schematic longitudinal sectional view of a second inventive design form of a headbox for a machine to produce a fibrous web from at least one fibrous stock suspension.
Figure 4:
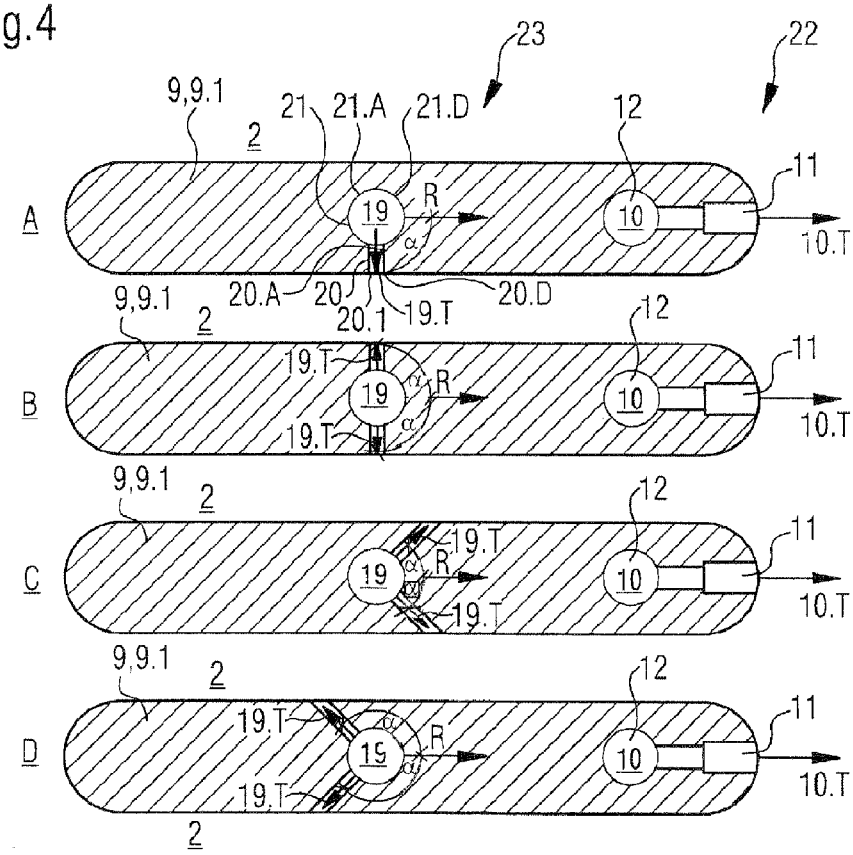
FIGS. 4A to 4D are four schematic cross sectional views of a means for preferably adjustable/controllable dosing of two fluids in partial fluid streams.
Figure 5:
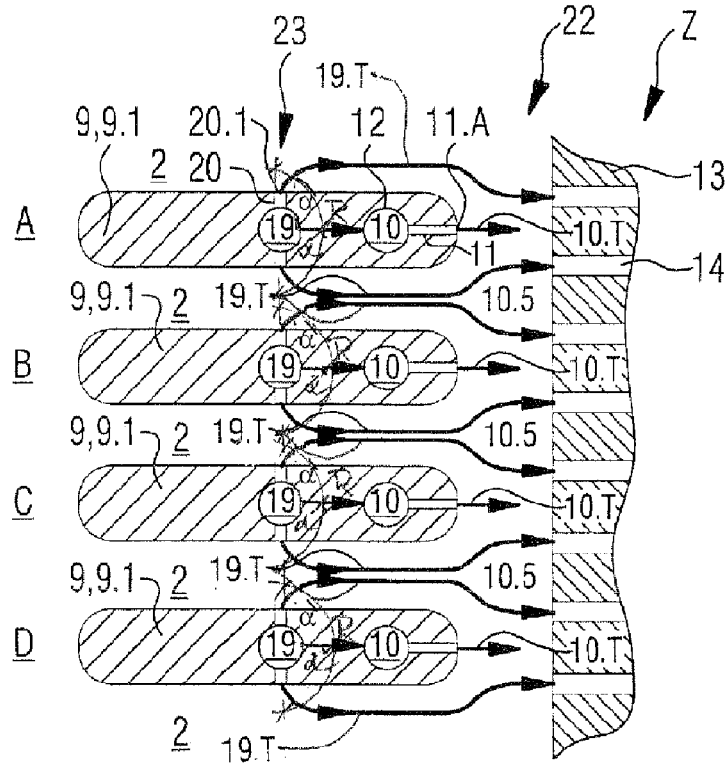
FIGS. 5A to 5D are four additional schematic cross sectional views of a means for preferably adjustable/controllable dosing of two fluids in partial fluid streams.

FIG. 3 shows a vertical and schematic longitudinal sectional view of a second inventive design form of a headbox 1 for a machine to produce a fibrous web from at least one fibrous suspension 2. The basic construction of this headbox 1 is substantially consistent with the basic construction of headbox 1 schematically depicted in FIG. 2. We therefore refer to the description provided for that drawing.

In a further development of headbox 1 illustrated in FIG. 2, the means 9 for preferably adjustable/controllable dosing of fluid 10 in partial fluid streams 10.T (arrows) into fibrous stock suspension 2 of headbox 1 illustrated in FIG. 3 is also designed for preferably adjustable/controllable dosing of two additional fluids 19, 24 in partial fluid streams 19.T, 24.T (arrows) into fibrous stock suspension 2. Herein the individual means 9 respectively comprises a plurality of dosing channels 25 for additional fluid 24, each having a respective dosing channel opening 25.1, discharging at different heights and being connected to a common supply channel 26.

Dosing of the two additional fluids 19, 24 into the one fibrous stock suspension 2 which is to be provided with a fluid 10 can be adjusted/controlled, at least in areas, in a manner obvious to the expert—in width direction B (arrow) of headbox 1, in other words in "Y" direction and/or in height direction of the headbox, in other words in "Z" direction.

Dosing channels 25 of means 9 for preferably adjustable/controllable dosing of the third fluid 24 in partial fluid streams 24.T (arrows) into fibrous stock suspension 2 which are connected with common supply channel 26 discharge again through dosing channel openings 25.1 on both sides of side area 23 of means 9 for preferably adjustable/controllable dosing, upstream from dosing channel openings 20.1 of dosing channels 20 for the additional fluid 19. Dosing channels 11 of means 9 for preferably adjustable/controllable dosing of fluid 10 in partial fluid streams 10.T (arrows) into fibrous stock suspension 2 which are connected with common supply channel 12 discharge through dosing channel openings 11.1 in downstream area 22 of means 9 for preferably adjustable/controllable dosing. Dosing channels 11, 20 of means 9 for preferably adjustable/controllable dosing of fluid 10 and the two additional fluids 19, 24 which discharge at different heights are arranged at equal distances A. Dosing channel openings 11.1, 20.1, 25.1 of dosing channels 11, 20, 25 can again be aligned toward each other, as shown in FIG. 3.

FIGS. 4A through 4D illustrate four schematic cross sectional views of a means 9 for preferably adjustable/controllable dosing of two fluids 10, 19 in partial fluid streams 10.T. 19.T (arrows).

Dosing channels 11 of all means 9 for preferably adjustable/controllable dosing of fluid 10 in partial fluid streams 10.T (arrows) into fibrous stock suspension 2 which are connected with common supply channel 12 discharge through dosing channel openings 11.1 in downstream area 22 of means 9 for preferably adjustable/controllable dosing.

In FIGS. 4B, 4C and 4D dosing channel openings 20.1 of dosing channels 20 of the three means 9 for preferably adjustable/controllable dosing of the additional fluid 19 in partial fluid streams 19.T (arrows) into fibrous stock suspension 2 discharge respectively on both sides of side area 23 of respective means 9 for preferably adjustable/controllable dosing. In the design example in FIG. 4B dosing channels 20 discharge at an angle $\alpha$ of 90° relative to the flow direction R (arrow) of fibrous stock suspension 2, in the example in FIG. 4C at an angle $\alpha$ of 45° relative flow direction R (arrow) of fibrous suspension 2 and in the example in FIG. 4D at an angle $\alpha$ of 135° relative to flow direction R (arrow) of fibrous stock suspension 2.

Solely in the example in FIG. 4A dosing channel openings 20.1 of dosing channels 20 of means 9 for preferably adjustable/controllable dosing of the additional fluid 19 in partial fluid streams 19.T (arrows) into fibrous stock suspension 2 discharge in one-sided side area 23 of medium 9 for preferably adjustable/controllable dosing at an angle $\alpha$ of 90° relative to flow direction R (arrow) of fibrous stock suspension 2.

Dosing channels 20 which are connected with common supply channel 21 of the respective means 9 for preferably adjustable/controllable dosing of the additional fluid 19 in partial fluid streams 19.T (arrow) into fibrous stock suspension 2 have a circular cross sectional surface 20.A with a diameter 20.D of 2 to 10 mm, preferably 4 to 6 mm. In addition, the common supply channel 21 of the individual means 9 for preferably adjustable/controllable dosing of the additional fluid 19 in partial fluid streams 19.T (arrows) into fibrous stock suspension 2 has a circular cross sectional surface 21.A with a diameter 21.D of 6 to 20 mm, preferably 10 to 15 mm. The individual cross sectional surface 20.A, 21.A can progress—at least in areas—constant, conical or stepped.

In addition dosing channels 20 of means 9 for preferably adjustable/controllable dosing of fluid 19 in partial fluid streams 19.T (arrows) into fibrous stock suspension 2 which are connected with the common supply channel 21 and which discharge through dosing channel openings 20.1 on both sides of the side area 23 of means 9 for preferably adjustable/controllable dosing can be arranged alternating.

For reasons of clarity only FIG. 4A shows all mentioned reference identifications.

FIGS. 5A through 5D show four additional cross sectional views of means 9 for preferably adjustable/controllable dosing of two fluids 10, 19 in partial fluid streams 10.T, 19.T (arrows).

Dosing channels 11 of means 9 for preferably adjustable/controllable dosing of fluid 10 in partial fluid streams 10.T (arrows) into fibrous stock suspension 2 which are connected with common supply channel 12 discharge through dosing channel openings 11.1 in downstream area 22 of means 9 for preferably adjustable/controllable dosing. Dosing channel openings 20.1 of dosing channels 20 of means 9 for preferably adjustable/controllable dosing of additional fluid 19 in partial fluid streams 19.T (arrows) into fibrous stock suspension 2 respectively discharge at an angle $\alpha$ of 90° relative to the flow direction R (arrow) of fibrous stock suspension 2 on both sides of side area 23 of respective means 9 for preferably adjustable/controllable dosing.

The number of dosing channels 20 of means 9 for preferably adjustable/controllable dosing of additional fluid 19 is the same as the number of rows Z of flow channels 14 of downstream turbulence generator 13. In addition, the number of dosing channels 20 of all means 9 for preferably adjustable/controllable dosing for additional fluid 19 is the same as the number of flow channels 14 of downstream turbulence generator 13.

For reasons of clarity only FIG. 5A shows all mentioned reference identifications.

Figure 6:
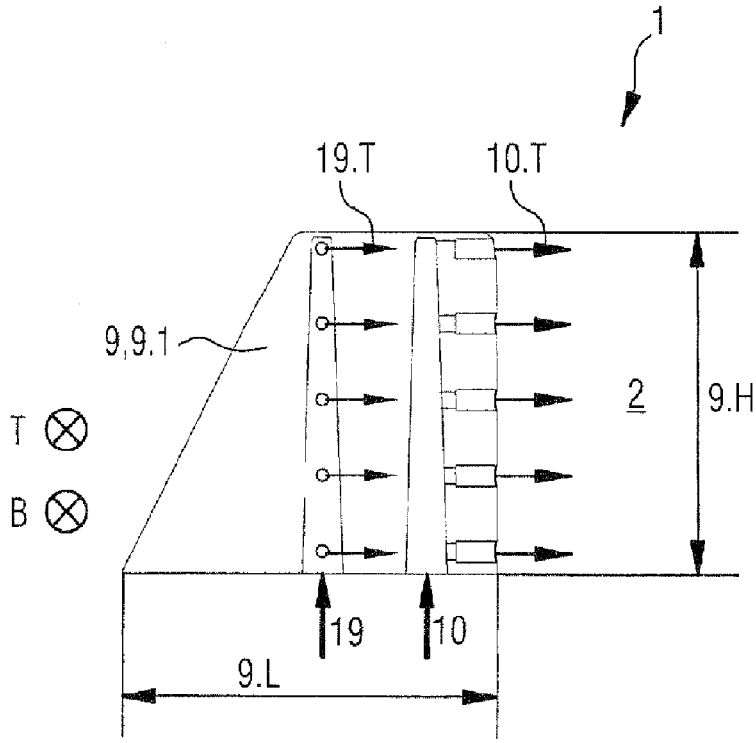
FIG. 6 is a schematic side view of the means for preferable adjustable/controllable dosing of two fluids of the headbox for a machine to produce a fibrous web from at least one fibrous stock suspension, illustrated in FIG. 2.

FIG. 6 shows a schematic side view of means 9 for preferably adjustable/controllable dosing of two fluids 10, 19 (arrows) in partial fluid streams 10.T, 19.T (arrows) of headbox 1 for a machine to produce a fibrous web from at least one fibrous stock suspension.

Means 9 for preferably adjustable/controllable dosing of at least two fluids 10, 19 (arrows) in partial fluid streams 10.T, 19.T (arrows) into the at least one fibrous stock suspension 2 comprises a dosing sword 9.1.

Means 9 in the form of dosing sword 9.1 for preferably adjustable/controllable dosing has a length 9.L in the range of 60 to 350 mm, preferably 100 to 250 mm and, depending upon the height of the intermediate chamber of headbox 1 has a height 9.H in the range of 50 to 300 mm, preferably 75 to 250 mm. Means 9, 9.1 for preferably adjustable/controllable dosing have preferably uniform spacing T in width direction of headbox 1 in the range of 10 to 100 mm, preferably 25, 33, 50 or 66 mm (also compare FIGS. 2 and 3).

Dosing sword 9.1 is described and illustrated in the German patent application DE 10 2008 054 898.7 (Applicant File: HPA14265 DE and Applicant-Title: "MJ II-DoS-TE-Geometry") with same German application date as the German patent application corresponding to the present application. The relating disclosure content of German Patent application DE 10 2008 054 898.7 is herewith made to the subject matter of the current description.

The properties of the design forms of respective inventive headbox 1, described in FIGS. 2 through 6 may be combined, at least partially, in ways obvious to the expert.

Fluid 10 flowing through the respective inventive headbox 1 in FIGS. 2 through 6 consists at least of water, especially clarified water, especially clarified water or white water or of at least one fibrous stock suspension whose concentration is different than the average concentration of the at least one fibrous stock suspension 2 flowing in headbox 1. In contrast, the at least one additional fluid 19, 24 flowing through inventive headbox 1 includes at least one retention agent, especially high molecular compounds like polyamines, polyamidoamines, polyacrylamides, polyethylenimines, cationic starch or guarderviates or a dewatering accelerator, especially polyamines or polyethylenimines.

Headbox 1, respectively illustrated and described in the drawings is especially suited for utilization in a machine to produce a fibrous web 3, in particular a paper or cardboard web from at least one fibrous stock suspension 2.

In summary it must be stated that a headbox of the type described at the beginning is improved by the invention in that the aforementioned disadvantages of the current state of the art are eliminated to the greatest possible extent, preferably completely. The headbox hereby enables in particular an efficient and cost effective addition of the at least additional fluid into the at least one fibrous suspension to which a fluid is added.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

1 Headbox
2 Fibrous stock suspension (arrow)
3 Web
4 Feed device
5 Cross distributor pipe
6 Perforated distributor pipe plate
7 Channel
8 Intermediate channel
9 Means for preferable adjustable/controllable dosing of a fluid
9.1 Dosing sword
9.H Height
9.L Length
10 Fluid (arrow)
10.T Partial fluid stream (arrow)
11 Dosing channel
11.1 Dosing channel opening
12 Supply channel
13 Turbulence generator
14 Flow channel

15 Machine-wide chamber
16 Headbox nozzle
17 Nozzle gap
18 Aperture
19 Fluid
19.T Partial fluid stream (arrow)
20 Dosing channel
20.1 Dosing channel opening
20.A Cross sectional surface
20.D Diameter
21 Supply channel
21.A Cross sectional surface
21.D Diameter
22 Downstream area
23 Side area
24 Fluid
24.T Partial fluid stream (arrow)
25 Dosing channel
25.1 Dosing channel opening
26 Supply channel
A Distance
B Width; width direction (arrow)
R Flow direction (arrow)
S Column
T Spacing (arrow)
Z Row
α Angle

What is claimed is:

1. A headbox for a machine for producing a web of fibrous material from at least one fibrous stock suspension, the web being one of a paper web and a cardboard web, said headbox comprising:

a feed apparatus configured for feeding the at least one fibrous stock suspension;

a perforated distributor pipe plate which is located adjacent downstream relative to said feed apparatus and which has a plurality of channels which are arranged in a plurality of rows and a plurality of columns;

an intermediate channel which is located downstream of said perforated distributor plate and extends over a width of the headbox, said intermediate channel including a first common supply channel, a second common supply channel, and a plurality of devices which are spaced apart from one another in a width direction of the headbox, said plurality of devices being configured for at least one of adjustable and controllable dosing of a first fluid in a first plurality of partial fluid streams into the at least one fibrous stock suspension, said plurality of devices individually and respectively including a first plurality of dosing channels for said first fluid, said first plurality of dosing channels respectively having one first dosing channel opening, said first plurality of dosing channels discharging at different heights and being connected with said first common supply channel, said plurality of devices configured for at least one of adjustable and controllable dosing of said first fluid in said first plurality of partial fluid streams into the at least one fibrous stock suspension being further configured for at least one of adjustable and controllable dosing of a second fluid in a second plurality of partial fluid streams into the at least one fibrous stock suspension, said plurality of devices individually and respectively including a second plurality of dosing channels for said second fluid, said second plurality of dosing channels each having respectively a second dosing channel opening, said second plurality of dosing channels discharging at different heights and being connected to said second common supply channel;

a turbulence generator downstream from said intermediate channel and having a plurality of flow channels arranged in a plurality of rows and a plurality of columns; and a headbox nozzle including a nozzle gap, said headbox nozzle being located immediately adjacent to said turbulence generator.

2. The headbox according to claim 1, wherein said first plurality of dosing channels of said plurality of devices for at least one of adjustable and controllable dosing of said first fluid in said first plurality of partial fluid streams into the at least one fibrous stock suspension which are connected with said first common supply channel discharge through a plurality of said first dosing channel opening in a downstream area of said plurality of devices for at least one of adjustable and controllable dosing, said second plurality of dosing channels of said plurality of devices for at least one of adjustable and controllable dosing of said second fluid in said second plurality of partial fluid streams into the at least one fibrous stock suspension which are connected with said second common supply channel discharge through a plurality of said second dosing channel opening at least on one side of a side area of said plurality of devices for at least one of adjustable and controllable dosing.

3. The headbox according to claim 1, wherein said first plurality of dosing channels of said plurality of devices for at least one of adjustable and controllable dosing of said first fluid in said first plurality of partial fluid streams into the at least one fibrous stock suspension which are connected with said first common supply channel discharge through a plurality of said first dosing channel opening in a downstream area of said plurality of devices for at least one of adjustable and controllable dosing, said second plurality of dosing channels of said plurality of devices for at least one of adjustable and controllable dosing of said second fluid in said second plurality of partial fluid streams into the at least one fibrous stock suspension which are connected with said second common supply channel discharge through a plurality of said second dosing channel opening on both sides of a side area of said plurality of devices for at least one of adjustable and controllable dosing.

4. The headbox according to claim 1, wherein said second plurality of dosing channels of said plurality of devices for at least one of adjustable and controllable dosing of said second fluid in said second plurality of partial fluid streams into the at least one fibrous stock suspension which are connected with said second common supply channel discharge through a plurality of said second dosing channel opening on at least one side of a side area of said plurality of devices for at least one of adjustable and controllable dosing, in an angle of 0° to 180° to a flow direction of the at least one fibrous stock suspension.

5. The headbox according to claim 1, wherein said second plurality of dosing channels of said plurality of devices for at least one of adjustable and controllable dosing of said second fluid in said second plurality of partial fluid streams into the at least one fibrous stock suspension which are connected with said second common supply channel discharge through a plurality of said second dosing channel opening on both sides of a side area of said plurality of devices for at least one of adjustable and controllable dosing, in an angle of 45° to 135° to a flow direction of the at least one fibrous stock suspension.

6. The headbox according to claim 1, wherein said second plurality of dosing channels of said plurality of devices for at least one of adjustable and controllable dosing of said second fluid in said second plurality of partial fluid streams into the at least one fibrous stock suspension which are connected with said second common supply channel discharge through a plurality of said second dosing channel opening on both sides of a side area of said plurality of devices for at least one of adjustable and controllable dosing, in an angle of approximately 90° to a flow direction of the at least one fibrous stock suspension.

7. The headbox according to claim 1, wherein respective ones of said second plurality of dosing channels of said plurality of devices for at least one of adjustable and controllable dosing of said second fluid in said second plurality of partial fluid streams into the at least one fibrous stock suspension which is connected with said second common supply channel has a circular cross-sectional surface with a diameter of 2 to 10 mm.

8. The headbox according to claim 1, wherein respective ones of said second plurality of dosing channels of said plurality of devices for at least one of adjustable and controllable dosing of said second fluid in said second plurality of partial fluid streams into the at least one fibrous stock suspension which is connected with said second common supply channel has a circular cross-sectional surface with a diameter of 4 to 6 mm.

9. The headbox according to claim 1, wherein said second common supply channel of said plurality of devices for at least one of adjustable and controllable dosing of said second fluid in said second plurality of partial fluid streams into the at least one fibrous stock suspension has a circular cross-sectional surface with a diameter of 6 to 20 mm.

10. The headbox according to claim 1, wherein said second common supply channel of said plurality of devices for at least one of adjustable and controllable dosing of said second fluid in said second plurality of partial fluid streams into the at least one fibrous stock suspension has a circular cross-sectional surface with a diameter of 10 to 15 mm.

11. The headbox according to claim 1, wherein said second plurality of dosing channels of said plurality of devices for at least one of adjustable and controllable dosing of said second fluid in said second plurality of partial fluid streams into the at least one fibrous stock suspension which are connected with said second common supply channel and which discharge through a plurality of said second dosing channel opening on both sides of a side area of said plurality of devices for at least one of adjustable and controllable dosing are arranged alternating.

12. The headbox according to claim 1, wherein said second plurality of dosing channels of said plurality of devices for at least one of adjustable and controllable dosing of said second fluid discharging at different heights are arranged at equal distances from each other.

13. The headbox according to claim 1, wherein a number of said second plurality of dosing channels in said plurality of devices for at least one of adjustable and controllable dosing of said second fluid is equal to a number of said plurality of rows of said plurality of flow channels in said turbulence generator.

14. The headbox according to claim 1, wherein a number of said second plurality of dosing channels in said plurality of devices for at least one of adjustable and controllable dosing of said second fluid is equal to a number of said plurality of flow channels in said turbulence generator.

15. The headbox according to claim 1, wherein said plurality of devices for at least one of adjustable and controllable dosing of the at least two fluids further has a uniform spacing in said width direction of the headbox in a range of 10 to 100 mm.

16. The headbox according to claim 1, wherein said plurality of devices for at least one of adjustable and controllable dosing of the at least two fluids further has a uniform spacing in said width direction of the headbox of one of 25 mm, 33 mm, 50 mm, and 66 mm.

17. The headbox according to claim 1, wherein each respective one of said plurality of devices for at least one of adjustable and controllable dosing of said first fluid and said second fluid in respectively said first plurality of partial fluid streams and said second plurality of partial fluid streams into the at least one fibrous stock suspension includes a dosing sword.

18. The headbox according to claim 1, wherein said plurality of devices respectively formed as a dosing sword for at least one of adjustable and controllable dosing of said first fluid and said second fluid in respectively said first plurality of partial fluid streams and said second plurality of partial fluid streams into the at least one fibrous stock suspension has a length in a range of 60 to 350 mm and a height in a range of 50 to 300 mm.

19. The headbox according to claim 1, wherein said plurality of devices respectively formed as a dosing sword for at least one of adjustable and controllable dosing of said first fluid and said second fluid in respectively said first plurality of partial fluid streams and said second plurality of partial fluid streams into the at least one fibrous stock suspension has a length in a range of 100 to 250 mm and a height in a range of 75 to 250 mm.

20. The headbox according to claim 1, wherein said first fluid consists of one of water and a fibrous stock suspension whose concentration is different than an average concentration of the at least one fibrous stock suspension flowing through the headbox, said water being one of white water and clarified water.

21. The headbox according to claim 1, wherein said second fluid includes one of (a) at least one retention agent formed as a high molecular compound which is one of a polyamine, a polyamidoamine, a polyacrylamide, a polyethylenimine, a cationic starch, and a guarderviate, and (b) a dewatering accelerator which is one of a polyamine and a polyethylenimine.

22. A machine to produce a web of fibrous material from at least one fibrous stock suspension, the web being one of a paper web and a cardboard web, said machine comprising:

at least one headbox including:

a feed apparatus configured for feeding the at least one fibrous stock suspension;

a perforated distributor pipe plate which is located adjacent downstream relative to said feed apparatus and which has a plurality of channels which are arranged in a plurality of rows and a plurality of columns;

an intermediate channel which is located downstream of said perforated distributor plate and extends over a width of said at least one headbox, said intermediate channel including a first common supply channel, a second common supply channel, and a plurality of devices which are spaced apart from one another in a width direction of said at least one headbox, said plurality of devices being configured for at least one of adjustable and controllable dosing of a first fluid in a first plurality of partial fluid streams into the at least one fibrous stock suspension, said plurality of devices individually and respectively including a first plurality of dosing channels for said first fluid, said first plurality of dosing channels respectively having one first dosing channel opening, said first plurality of dosing channels discharging at different heights and being connected with said first common supply channel, said plurality of devices configured for at least one of adjustable and controllable dosing of said first fluid in said first plurality of partial fluid streams into the at least one fibrous stock suspension being further configured for at least one of adjustable and controllable dosing of a second fluid in a second plurality of partial fluid streams into the at least one fibrous stock suspension, said plurality of devices individually and respectively including a second plurality of dosing channels for said second fluid, said second plurality of dosing channels each having respectively a second dosing channel opening, said second plurality of dosing channels discharging at different heights and being connected to said second common supply channel;

a turbulence generator downstream from said intermediate channel and having a plurality of flow channels arranged in a plurality of rows and a plurality of columns; and a headbox nozzle including a nozzle gap, said headbox nozzle being located immediately adjacent to said turbulence generator.

* * * * *